US006164003A

United States Patent [19]

Miller

[11] Patent Number: 6,164,003

[45] Date of Patent: Dec. 26, 2000

[54] HEATED FIREARM STOCK

[76] Inventor: Ronald Alvin Miller, 5650 Park Hollow St., Wichita, Kans. 67275

[21] Appl. No.: 09/196,837

[22] Filed: Nov. 20, 1998

[51] Int. Cl.[7] ..... F41C 23/00; F41C 27/00

[52] U.S. Cl. ..... 42/71.01; 42/106; 126/204; 219/201

[58] Field of Search ..... 42/71.01, 84, 90, 42/106; 89/1.12; 126/204; 219/201

[56] References Cited

U.S. PATENT DOCUMENTS

| | | | |
|---|---|---|---|
| 744,739 | 11/1903 | Fliess | 219/204 |
| 2,403,415 | 7/1946 | Van Daam | 89/1.12 |
| 2,404,736 | 7/1946 | Marick | 89/1.12 |
| 2,498,983 | 2/1950 | D'Albora | 126/204 |
| 2,609,479 | 9/1952 | Loewe | 89/1.12 |
| 2,769,892 | 11/1956 | Collins | 126/204 |
| 3,031,557 | 4/1962 | Gibbs | 219/201 |
| 3,057,342 | 10/1962 | Woodzick | 42/106 |
| 3,167,875 | 2/1965 | Winner et al. | 42/106 |
| 3,742,635 | 7/1973 | Hutto | 42/106 |
| 4,471,209 | 9/1984 | Hollander . | |
| 4,598,192 | 7/1986 | Garrett . | |
| 4,754,498 | 7/1988 | Stinemates | 42/106 |
| 4,937,429 | 6/1990 | Hollander . | |
| 4,947,573 | 8/1990 | Bischoff | 42/106 |
| 5,517,786 | 5/1996 | Peissig | 43/18.1 |
| 5,585,026 | 12/1996 | Smith, Jr. et al. . | |
| 5,655,328 | 8/1997 | Childs et al. | 43/25 |
| 5,786,574 | 7/1998 | Garnett | 219/529 |
| 5,934,267 | 8/1999 | Briner | 124/88 |

FOREIGN PATENT DOCUMENTS

| | | | |
|---|---|---|---|
| 480269 | 7/1929 | Germany | 42/71.01 |

*Primary Examiner*—Darren W. Ark

*Attorney, Agent, or Firm*—Flanagan & Flanagan; John R. Flanagan; John K. Flanagan

[57] ABSTRACT

A heated firearm or shotgun stock of the present invention includes a set of batteries, a switch, connecting wires and a generally flat electrically heated insert for locally heating a portion of the stock surface. When the switch is closed, the electric current flowing through resistance heating element in the heated insert causes the insert to warm thereby heating a portion of firearm stock surface.

15 Claims, 1 Drawing Sheet

HEATED FIREARM STOCK

CROSS REFERENCES TO RELATED APPLICATIONS

This application claims the benefit of U.S. Provisional Patent Application entitled "Heated Pistol Grip Synthetic Shotgun and Rifle Stocks", Ser. No. 60/101991 filed Sep. 28, 1998, filed by Ronald A. Miller of Wichita, Kans.

BACKGROUND OF THE INVENTION

1. Field of the Invention

The present invention relates to a device for heating a portion of the surface of a firearm stock and more particularly pertains to warming the fingers of the shooting hand of a hunter in cold conditions to improve his or her comfort, and marksmanship as well as to improve his or her ability to safely operate the trigger and safety mechanism of the firearm.

2. Description of prior art

Heated grips and handles are known to exist in the prior art. By way of example, Hollander in U.S. Pat. 4,471,209 discloses electrically heated hand grips for vehicle handle bars. Garrett in U.S. Pat. No. 4,598,192 discloses an electrically heated handle for a fishing rod. Smith in U.S. Pat. No. 5,585,026 discloses an electrically heated handle grip for a bow handle.

While these devices accomplish their respective purposes, none of them accomplishes the specific purpose of heating a portion of the stock of a firearm such as a rifle or a shotgun. More particularly, the above mentioned patents do not teach a built-in device for electrically heating a portion of a firearm stock so that a hunter may warm his or her shooting hand while holding carrying , aiming or shooting a firearm.

Most sport hunting seasons are conducted during cold weather. While hunting game in cold weather, hunters often need to remain hidden, quiet and nearly motionless in blinds or in stands or are often walking in open areas and are exposed to wind and cold. Consequently, a hunter in cold weather is confronted with the alternatives of wearing heavy gloves or shooting bare handed with cold, stiff fingers. Both alternatives will limit the hunter's ability to operate the firearm safely and effectively. A hunter with heavily gloved or cold, numb fingers is more likely to misfire or leave a safety off when it is thought to be engaged. Accordingly, for reasons of safety and comfort, there exists a continuing need for a simple, reliable device that is built into a firearm stock and that locally heats a selected portion of the firearm stock surface so that a hunter using the firearm can operate it more comfortably and effectively with a warm, dexterous trigger hand.

SUMMARY OF THE INVENTION

The heated firearm stock of the present invention satisfies the aforementioned need by providing a simple, reliable, integral device for heating a portion of the outer surface of a firearm stock. The heated firearm stock of the present invention includes, in the broadest context, a compact electrical power source that is connected in a circuit to a heated insert located in or on the surface of the firearm stock. The electrical circuit can include a switch or the electrical power source such as a battery pack can be adapted so that it can be easily attached or removed. In the preferred embodiment, the circuit includes a switch and the heated insert includes an electrical resistance heating element that has two terminals. The insert can be mounted in a recessed portion of the surface of the firearm stock to provide a heated portion of the outer surface of the firearm stock . The compact electrical power source, in the preferred embodiment, includes two batteries that can be easily mounted in series in a battery compartment located near the butt end of the firearm stock. A first wire leaving the battery compartment connects to the first of the two terminals of the electrical resistance heating element of the insert. A second wire connects the battery compartment to the switch. A third wire completes a switchable circuit by connecting the switch with the second of the two terminals of the electrical resistance heating element of the insert. When the switch is closed, electrical current flows through the completed circuit and causes the electrical resistance heating element to heat the insert and thereby cause a portion of the firearm stock surface to be heated.

As can be seen from the forgoing description, the heated firearm stock of the present invention has several advantages. The heated firearm stock of the present invention is a simple and highly effective means for locally heating a portion of the firearm stock surface. Because the heated firearm stock of the present invention is simple, it could be added to a synthetic or composite firearm stock configuration without adding significant cost to the firearm stock manufacturing process. Since the components of the heated firearm stock can be easily integrated into a synthetic or composite firearm stock, a heated firearm stock can be manufactured that has virtually the same appearance as an ordinary firearm stock. Even the heated insert can be placed in a recessed portion of the firearm stock and disguised with the same finish and color as the surrounding portions of the firearm stock so that it would not be noticed by a casual observer. Most importantly, the heated firearm stock of the present invention makes it possible for a hunter, in cold weather, to accomplish the delicate and sensitive task of aiming and firing a firearm without the hazard, distraction and interference of a gloved trigger hand or cold, numb fingers.

BRIEF DESCRIPTION OF THE DRAWINGS

The following detailed description refers to the attached drawings in which.

DETAILED DESCRIPTION OF THE PREFERRED EMBODIMENT

Figure 1:
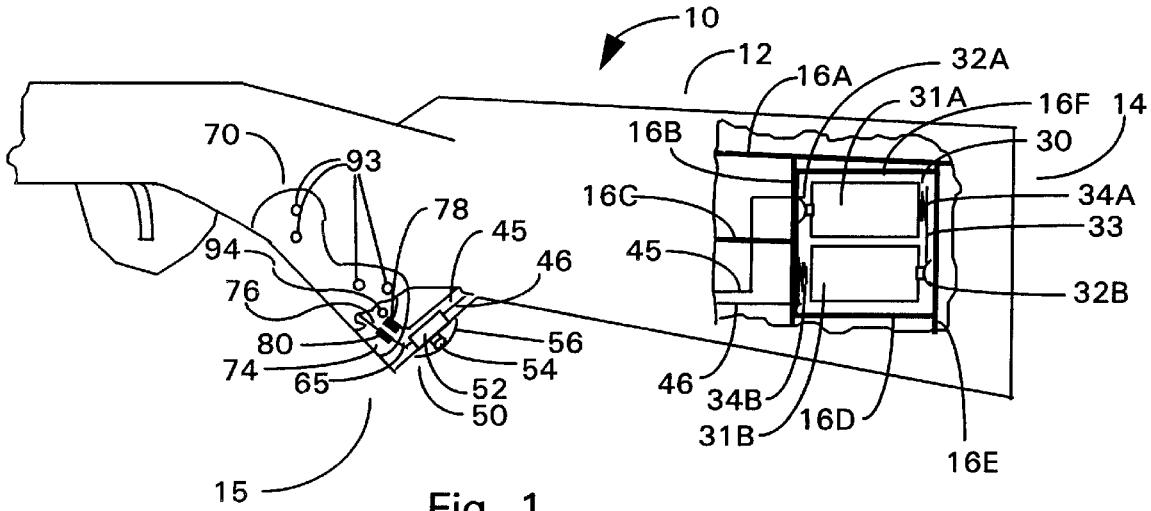
FIG. 1 is a side view of the heated firearm stock of the present invention.

As shown in FIG. 1, the heated firearm stock 10 of the present invention includes a synthetic or composite firearm stock 12, which includes a battery compartment 30 containing batteries 31A and 31B, a switch 50, a heated insert 70, first wire 45, second wire 46 and third wire 65.

As can be further seen in FIG. 1, stock 12 includes a butt end 14 and a pistol grip portion 15. Stock 12 is of a generally hollow construction and includes internal structural webs 16A, 16B, 16C, 16D, 16E and 16F that give strength and rigidity to stock 12. Near the butt end 14 of stock 12 and placed between the internal structural webs 16D and 16F of stock 12, is a battery compartment 30 that holds two batteries, 31A and 31B. Battery compartment 30 includes a first positive contact 32A, a first negative contact 34A, a second positive contact 32B and a second negative contact 34B. First negative contact 34A and second positive contact 32B are connected by conductor 33. Batteries 31A and 31B are arranged so that their electrical potentials are added to yield a single larger electrical potential between first positive contact 32A and second negative contact 34B. Battery compartment 30 would also include a door or hatch (not shown) that would close off battery compartment 30.

As can be further seen in FIG. 1, first wire 45 is connected to first positive contact 32A of battery compartment 30 and second wire 46 is connected to second negative contact 34B of battery compartment 30. First wire 45 also connects with a first terminal 78 of heated insert 70 while second wire 46 leads to switch 50. The construction of heated insert 70 will be described in greater detail below. Third wire 65 leads from a second terminal 80 of heated insert 70 to switch 50 to complete a switchable circuit. In this preferred embodiment, switch 50 is located at the bottom of pistol grip portion 15 of stock 12. Switch 50 includes switch box 52, containing a push on/push off switching mechanism, a post 54 for actuating the push on/push off switching mechanism and a flexible membrane 56 for protecting switch box 52 and post 54.

Figure 2:
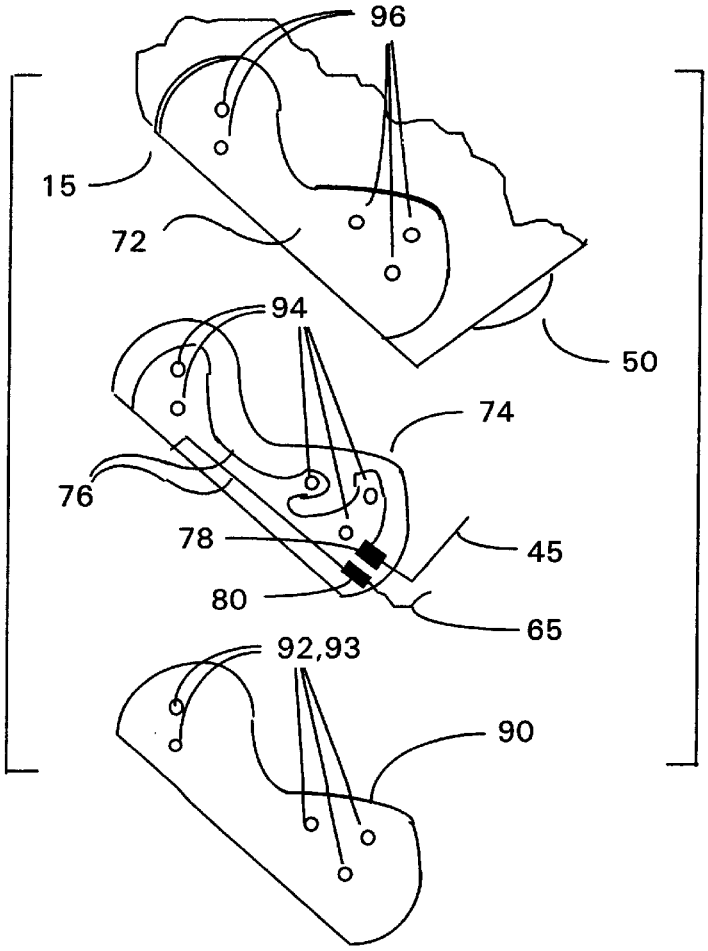
FIG. 2 is an exploded view of the heated insert.

FIG. 2 provides an exploded view of heated insert 70. Heated insert 70 is adapted to fit flush into a recessed portion 72 of pistol grip portion 15. FIG. 2 is a side view, and it should be understood by the reader that the portions of the structures shown in FIG. 2 are generally repeated on the opposite, hidden side of pistol grip portion 15. Heated insert 70 includes first insert portion 74, a resistance heating element 76 and a second insert portion 90. First insert portion 74, is fashioned from a flexible material such as rubber gasket material that is flexible, resilient, heat resistant, thermally insulating as well as electrically insulating. As can be seen in FIG. 2, resistance heating element 76 is fixed to first insert portion 74. A small amount of glue or epoxy is used to secure element 76 in place. Resistance heating element 76 can be fashioned from 29 GA Nicrome wire having a resistance of 5.3 Ohms per foot. Resistance heating element 76 reticulates about the surface of first insert portion 74 and ends in terminals 78 and 80 which are adapted to receive wires 45 and 65 respectively. A sufficient length of Nicrome wire should be used for resistance heating element 76 so that the ratio of wire length in inches to heated insert 70 surface area in square inches is between 0.5 and 1.5 to one. Heated insert 70 should have a surface area of no more than eight square inches. When using an optimal eight inches of Nicrome wire as described above over a heated insert area of five square inches in combination with two Energizer™ C Cell batteries, heated insert 70 heats from room temperature of 72° F. to a temperature of 100° F. in 7 minutes and to a temperature of 105° F. in 15 minutes. Heated insert thus configured and heated stays above 100° F. for 2 hours 45 minutes and falls back to room temperature at 5 hours and 30 minutes.

Second insert portion 90 is adapted to conduct heat but to not conduct electricity. Second insert portion 90 can be fashioned from a thin, formable sheet of copper that is coated with Halar, a sprayable plastic material that conducts heat but does not conduct electricity. Second insert portion 90 could also be fashioned from some other moldable material that conducts heat and yet does not conduct electricity such as a ceramic or a composite such as fiberglass. Polymer resins that conduct heat but do not conduct electricity are also known in the art and can be molded to fashion second insert portion 90. Second insert portion 90 has a number of countersunk holes 92 adapted for receiving a corresponding number of countersunk fasteners 93. First insert portion 74 has a number of holes 94 corresponding to countersunk holes 92 in second insert portion 90. Grip portion 15 has yet a third set of holes 96 adapted for receiving countersunk fasteners 93.

Heated insert 70 is assembled and installed by locating first insert portion 74 in recessed portion 72 of pistol grip portion 15. Wires 45 and 65 should then be connected to terminals 78 and 80 of first insert portion 74. After wires 45 and 65 are connected, a silicone based heat sink compound (not shown) of the type commonly used to facilitate heat transfer in electrical components is applied to resistance heating element 76, second insert portion 90 is placed over first insert portion 74 and then fastened in place by countersunk fasteners 93.

When the completed heated firearm stock 10 of the present invention is assembled, switch 50 may be switched to a closed position. Electrical current from batteries 31A and 31 B can then flow through the completed circuit which includes resistance heating element 76. As resistance heating element 76 generates heat, second insert portion 90 warms evenly to provide a uniformly heated surface. At the same time, first insert portion 74 which is made from a thermally insulating material prevents most of that heat from transferring into the remainder of firearm stock 12 where it would dissipate and be wasted.

As can be easily understood by those skilled in the art, the function of switch 50 can be replaced by a battery pack that can be easily attached or removed. In such an alternative embodiment, attaching a charged battery pack would fulfill the same function as closing a switch and providing electric current to the heated insert 70. Removing the charged battery pack would fulfill the same function as closing a switch and shutting off electric current to heated insert 70.

As can be seen from the forgoing description, heated firearm stock 10 accomplishes the objectives of the invention. Heated firearm stock 10 can look very much like an ordinary firearm stock, yet it includes a simple, reliable means for locally heating a portion of the firearm stock surface. A hunter may use heated firearm stock 10 without resorting to any specialized equipment or processes and a hunter using heated firearm stock 10 will experience the comfort and safety enhancing advantages of aiming and firing with a warm and comfortable trigger hand.

The skilled reader, in view of this specification may envision numerous modifications and variations of the above disclosed preferred embodiment. Accordingly, the reader should understand that these modifications and variations, and the equivalents thereof, are within the spirit and scope of this invention wherein I claim:

What is claimed is:

1. A heated firearm stock, comprising:

(a) a firearm stock having a pistol grip portion;

(b) an electrical power source having a first contact and a second contact and an electrical potential between the first and second contacts;

(c) a heated insert positioned on the pistol grip portion of the firearm stock, the heated insert including a thermally-conductive electrically-insulating portion and an electrical resistance heating element disposed in direct contact therewith and adapted to conduct an electrical current and to warm the thermally-conductive electrically-insulating portion in response to the electrical current, the electrical resistance heating element having first and second electrical terminals for establishing an electrical connection therewith;

(d) a first wire connecting the first terminal of the heated insert to the first contact of the electrical power source; and (e) a second wire connecting the second contact of the electrical power source with the second terminal of the heated insert thereby completing an electrical circuit which includes the electrical power source and the heated insert such that when electrical current flows through the electrical circuit the heated insert is heated to provide a heated surface on the pistol grip portion of the firearm stock.

2. A heated firearm stock, comprising:

(a) a firearm stock;

(b) an electrical power source having a first contact and a second contact and an electrical potential between the first and second contacts;

(c) a heated insert positioned on the firearm stock, the heated insert including (i) an electrically and thermally insulating first insert portion, (ii) a thermally conductive and electrically insulating second insert portion, and (iii) an electrical resistance heating element disposed between the first and second insert portions and adapted to conduct an electrical current and to warm the second insert portion in response to the electrical current, the electrical resistance heating element having first and second electrical terminals for establishing an electrical connection therewith;

(d) a first wire connecting the first terminal of the heated insert to the first contact of the electrical power source; and (e) a second wire connecting the second contact of the electrical power source with the second terminal of the heated insert thereby completing an electrical circuit which includes the electrical power source and the heated insert such that when electrical current flows through the electrical circuit the heated insert is heated to provide a heated surface on a portion of the firearm stock.

3. The firearm stock of claim 2, wherein the electrical power source is a battery pack.

4. The firearm stock of claim 2, wherein the electrical resistance heating element includes a single strand of Nicrome wire disposed in a reticulated fashion between the first and second insert portions.

5. The firearm stock of claim 4, wherein the firearm stock has a recessed portion adapted for receiving the heated insert.

6. The firearm stock of claim 5, wherein the heated insert is adapted to conform to the recessed portion of the firearm stock.

7. The firearm stock of claim 2, wherein the firearm stock has a pistol grip portion and the heated insert is wrapped at least partially around the pistol grip portion of the firearm stock.

8. A heated firearm stock, comprising:

(a) a firearm stock;

(b) a battery compartment in the firearm stock having first and second contacts for maintaining an electrical connection;

(c) at least one battery disposed in the battery compartment and electrically connected with the first and second contacts of the battery compartment;

(d) an electrical switch adapted to be placed in opened and closed positions;

(e) a heated insert positioned on the firearm stock, the heated insert including (i) an electrically and thermally insulating first insert portion, (ii) a thermally conductive and electrically insulating second insert portion, and (iii) an electrical resistance heating element disposed between the first and second insert portions and adapted to conduct an electrical current and to warm the second insert portion in response to the electrical current, the electrical resistance heating element having first and second electrical terminals for establishing an electrical connection therewith;

(f) a first wire connecting the first terminal of the heated insert to the first contact of the battery compartment;

(g) a second wire connecting the second contact of the battery compartment with the switch; and (h) a third wire connecting the electrical switch to the second terminal of the heated insert thereby completing a switchable electrical circuit which includes the at least one battery and the heated insert such that when the electrical switch is placed in the closed position electrical current flows through the electrical circuit and the heated insert is heated to provide a heated surface on a portion of the firearm stock.

9. The firearm stock of claim 8, wherein the electrical resistance heating element includes a single strand of Nicrome wire disposed in a reticulated fashion between the first and second insert portions.

10. The firearm stock of claim 8, wherein the firearm stock has a recessed portion adapted for receiving the heated insert.

11. The firearm stock of claim 10, wherein the heated insert is adapted to conform to the recessed portion of the firearm stock.

12. The firearm stock of claim 8, wherein the firearm stock has a pistol grip portion and the heated insert is wrapped at least partially around the pistol grip portion of the firearm stock.

13. The firearm stock of claim 8, wherein the firearm stock has a butt end and the battery compartment is situated inside the firearm stock near the butt end of the firearm stock.

14. The firearm stock of claim 13, wherein the firearm stock has a pistol grip portion and the heated insert is wrapped at least partially around the pistol grip portion of the firearm stock.

15. The firearm stock of claim 14, wherein the electrical switch is mounted at a bottom of the pistol grip portion of the firearm stock.

* * * * *